United States Patent [19]

Carr

[11] 4,324,008

[45] Apr. 13, 1982

[54] DISPOSABLE SITZ BATH

[76] Inventor: John W. Carr, 1158 Grove St., Maitland, Fla. 32751

[21] Appl. No.: 169,617

[22] Filed: Jul. 17, 1980

[51] Int. Cl.[3] ..... A47K 3/22; A47K 4/00; A47K 3/20

[52] U.S. Cl. ..... 4/445; 4/446; 4/420.3

[58] Field of Search ..... 4/443, 445, 446, 144.2, 4/DIG. 18, 580, 484, 451, 452, 453

[56] References Cited

U.S. PATENT DOCUMENTS

| | | | |
|---|---|---|---|
| 1,655,864 | 1/1928 | Haslett | 4/445 |
| 2,251,039 | 7/1941 | Silva | 4/445 |
| 2,817,851 | 12/1957 | Barnwall | 4/DIG. 18 X |
| 3,102,273 | 9/1963 | McCarthy | 4/444 X |
| 3,381,315 | 5/1968 | Glassberg | 4/484 |
| 3,605,127 | 9/1971 | Dailey | 4/452 |
| 3,916,452 | 11/1975 | Alt | 4/445 |

*Primary Examiner*—Henry K. Artis

*Attorney, Agent, or Firm*—Harness, Dickey & Pierce

[57] ABSTRACT

The disclosure relates to a flexible membrane configured and dimensioned so as to be capable of lining a conventional toilet bowl thereby to function as a sitz bath. The membrane extends into the toilet bowl and has an integral overflow pipe for the discharge of excess water thereby to maintain a desired water temperature and level within the bath. Adhesive tabs on the membrane secure the peripheral edge thereof to the outer side portions of the toilet bowl.

2 Claims, 2 Drawing Figures

DISPOSABLE SITZ BATH

BACKGROUND OF THE INVENTION

Reference should be made to prior art U.S. Pat. Nos. 2,426,303, 3,947,995 and 3,947,995 which teach various types of sitz baths.

SUMMARY OF THE INVENTION

A flexible membrane is constructed so as to be positionable in a toilet bowl. A user assumes a sitting position over the basin and is provided with water flow control means for selectively flowing water into the membrane within the bowl during the soaking period in which the perineal regions are immersed in the basin. A relatively rigid discharge tube is provided externally of the membrane to control the water level. A flexible hose is connected to a water faucet remote from the toilet bowl. In order to comply with sanitary codes, a simple anti-siphoning supply tube is hooked over the front lip of the toilet bowl with the discharge end thereof spaced from the discharge tube thereby to insure against back siphonage of water from the sitz bath to the water supply system.

The objects and advantages of the instant invention will be readily understood from the following detailed description and accompanying drawings.

DETAILED DESCRIPTION OF THE DRAWINGS

Figure 1:
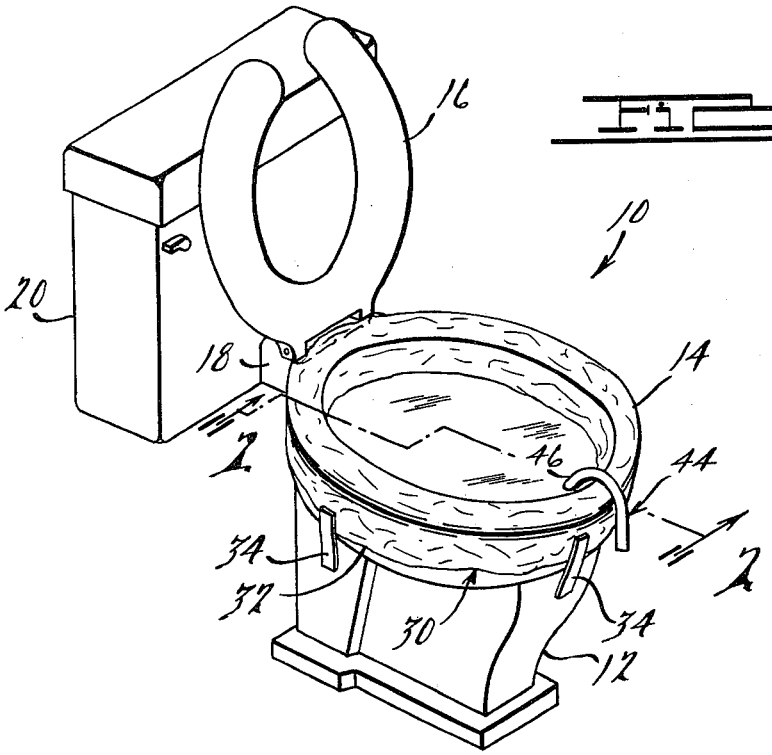
FIG. 1 is a view, in perspective, of a conventional toilet bowl, having the sitz bath of the present invention disposed in operative position thereon.

Referring to the drawings, a conventional toilet 10 has a bowl 12 with a rim 14 disposed in a substantially horizontal plane. A conventional seat 16 is journaled on a rearward extension 18 of the toilet bowl 12. The extension 18 also supports a conventional water closet 20.

The sitz bath of the invention comprises a membrane 30, of for example 5 mil vinyl, designed to be supported in operative position on the uppermost surface of the bowl when the seat is in fully raised position away from the bowl. While the sitz bath membrane 30 may be configured and dimensioned so as to be disposed over the seat 16 or on the rim 14 of the bowl 12, support thereof by the seat 16 reduces the depth to which the perineal areas may be submerged. An edge portion 32 of the membrane 30 is secured to the outer surface of the bowl 12 by a plurality of adhesive tabs 34.

Figure 2:
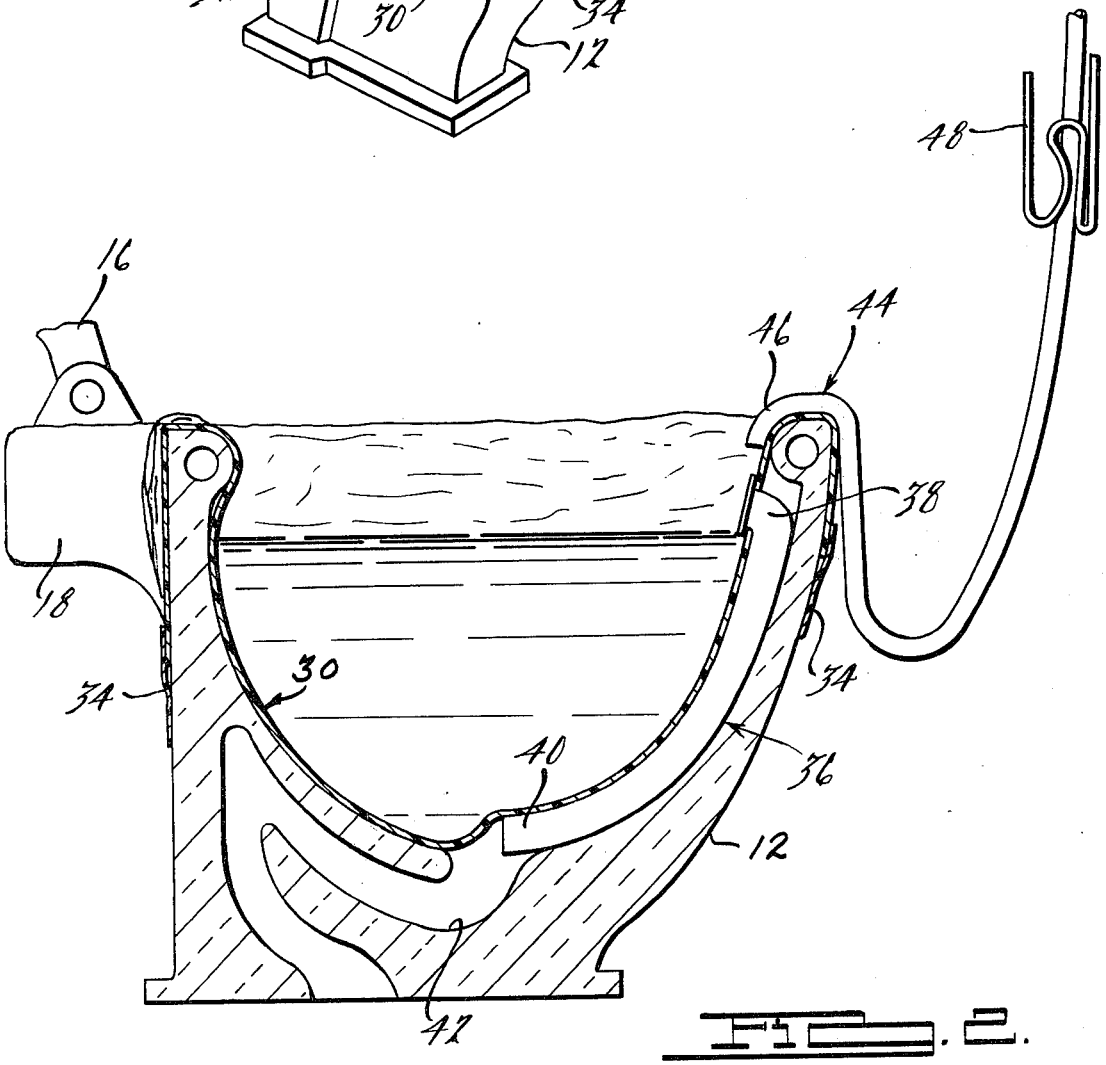
FIG. 2 is a view in cross-section, partly broken away, taken generally along lines 2—2 of FIG. 1.

As seen in FIG. 2, a relatively rigid discharge tube 36 has an upper end portion 38 that extends through the membrane 30. The vertical position of the end portion 38 of the tube 36 controls the depth of the water in the membrane 30 and bowl 12. It is important that the lower end 40 of the tube 36 extend into close proximity to the discharge passage 42 of the toilet bowl 12 so as to insure that water passing down the tube 36 is not blocked by the relatively flexible membrane 30.

To condition the sitz bath of the instant invention for use, a user need merely insert the membrane 30 into the bowl 12 with the discharge tube 36 in proper position. Thereafter, the tabs 34 are secured to the bowl 12.

Filling of the sitz bath with water is achieved by connecting a hose 44 to a conventional faucet (not shown). The hose 44 has an end portion 46 hooked over the rim 14 of the bowl 12 so as to be maintained in spaced relation to the end 38 of the discharge tube 36 thereby to be held above the level of the water in the bowl 12. A flow control clip 48 is provided on the tube 44 to control input of water into the sitz bath.

After use of the sitz bath is terminated, the tabs 34 are released, after which the membrane 30 is merely perforated and drawn upwardly allowing residual water to flow through the perforation into the toilet bowl for flushing in the normal manner.

It is understood that the foregoing description is that of the preferred embodiments of the invention and that various changes and modifications may be made thereto without departing from the spirit and scope of the invention, as defined in the appended claims.

What is claimed is:

1. A disposable sitz bath for use in conjunction with a conventional toilet comprising a flexible membrane adapted to be disposed internally of the toilet bowl, so as to be engageable with and supported by the interior surface thereof, said membrane having a peripheral edge adapted to extend above and overlie the rim portion of said toilet bowl, means for securing the peripheral edge of said membrane to an exterior surface of said toilet, and a semi-rigid non-collapsible water control tube sealably secured about an aperture in the upper portion of said membrane so as to communicate with the interior surface thereof, said tube being adapted to extend between the aperture in said membrane between said membrane and said bowl downwardly to a point adjacent to and in fluid flow communicating relationship to the discharge outlet of said toilet bowl, the rigidity of said water control tube being sufficient to prevent collapse thereof due to static pressure of water interiorly of said membrane in said toilet bowl.

2. A sitz bath in accordance with claim 1 wherein said securing means comprises a plurality of adhesive tabs.

* * * * *